US008225468B2

(12) United States Patent
Wanzenboeck

(10) Patent No.: US 8,225,468 B2
(45) Date of Patent: Jul. 24, 2012

(54) CLOSURE FOR A BRASSIERE

(75) Inventor: Karl Wanzenboeck, Teesdorf (AT)

(73) Assignee: Fildan Accessories (HK) Ltd., Kwun Tong Kowloon (HK)

( * ) Notice: Subject to any disclaimer, the term of this patent is extended or adjusted under 35 U.S.C. 154(b) by 656 days.

(21) Appl. No.: 12/277,593

(22) Filed: Nov. 25, 2008

(65) Prior Publication Data

US 2009/0133230 A1 May 28, 2009

(30) Foreign Application Priority Data

Nov. 28, 2007 (DE) ..... 10 2007 057 587

(51) Int. Cl.
*A44B 17/00* (2006.01)
*A41F 19/00* (2006.01)
*A41F 9/00* (2006.01)

(52) U.S. Cl. ..... 24/586.11; 24/587.12; 24/588.12

(58) Field of Classification Search ..... 24/586.11, 24/588.12, 587.12, 586.1, 115 F, 164, 171, 24/573.11, 578.1, 578.15, 590.1; 450/58, 450/46

See application file for complete search history.

(56) References Cited

U.S. PATENT DOCUMENTS 1,126,610 A * 1/1915 Woolf ..... 24/578.1
2,165,928 A * 7/1939 Krischer ..... 24/578.15
2,956,324 A * 10/1960 Klein ..... 24/323
3,520,033 A * 7/1970 Usuda ..... 24/590.1
3,765,062 A * 10/1973 Cruse ..... 24/587.12
4,413,383 A * 11/1983 Spalding ..... 24/164
4,621,393 A * 11/1986 Ambal ..... 24/171
4,779,315 A * 10/1988 Kohus ..... 24/587.12
5,224,247 A * 7/1993 Collier ..... 24/587.12
5,261,257 A * 11/1993 Collier ..... 70/456 R
D349,473 S * 8/1994 Fildan ..... D11/212
5,735,024 A * 4/1998 Ortiz ..... 24/573.11
6,499,201 B2 * 12/2002 Fildan et al. ..... 24/586.11
6,826,806 B2 * 12/2004 Eaton et al. ..... 24/115 F
7,290,313 B2 * 11/2007 Southern ..... 24/614
2002/0095752 A1 * 7/2002 Fildan et al. ..... 24/586.11

* cited by examiner

*Primary Examiner* — Robert J Sandy
*Assistant Examiner* — Abigail E Morrell
(74) *Attorney, Agent, or Firm* — Andrew Wilford

(57) ABSTRACT

A brassiere closure has a pair of closure parts each having an eye with inner and outer parallel longitudinal webs. A separation plane passes through both of the webs and the slot, and a transverse central plane perpendicular to the separation plane passing centrally through the slot and both of the webs. A bridge extend transversely from the inner web has a planar floor face lying on the separation plane and is formed offset along the separation plane from the transverse plane with a throughgoing latch opening. A hook carried on the bridge spaced has an edge formed of sections directed toward and forming a V-shaped opening with the edge of the bridge. An outer edge of the hook carries a pin engageable in the closed position through a latch opening of the bridge of the other closure part.

2 Claims, 3 Drawing Sheets

CLOSURE FOR A BRASSIERE

FIELD OF THE INVENTION

The invention relates to a closure for a brassiere comprising two closure parts made of plastic and that may be secured to one another by means of latches in a non-positive manner and wherein at least two such latches comprise female latching elements and male latching elements that may be fixedly and releasably connected to one another by mutual engagement and that may be released again from one another by release actuation, wherein, viewed in the closed configuration of the closure, the latches are arranged and designed to be point-symmetrical relative to the geometric center of the closure, and wherein further the closure parts for connecting to strip-shaped support elements have slot-shaped eyes that are parallel to longitudinal edges of the eye openings and substantially symmetrical relative to a longitudinal center plane of the closure extending between the eye openings.

BACKGROUND OF THE INVENTION

Such closures are often configured as so-called simple closures in which the two closure elements are of identical configuration, i.e. the hooks and eyes are present to the same extent in both closure elements. In such a "simple" closure, in the assembled state of the closure parts, a point-symmetrical design of the closure results overall, such that two points of the two closure parts corresponding to one another are "geometrically" connected by a straight line that passes through the common geometric center of the parts in their closed configuration. This "point-symmetrical" configuration results in mirror symmetry of the eye regions of the brassiere closure, both relative to a "longitudinal" central plane of the entire arrangement extending between the generally elongate eyes of the closure parts and also relative to a "transverse" central plane of the entire arrangement extending at right angles thereto.

The closure parts of the known brassiere closures are configured as injection-molded plastic parts whose latching projection elements engaging behind the latching edges also have to provide security against the closure elements pulling apart, i.e. relatively small parts engage behind edges of "female" latching openings configured as small openings in the central region of the webs bordering the eye openings.

In the generally known brassiere closures of this type it is acknowledged that tensile forces acting on the closure elements and acting in the opposing direction are only able to be absorbed to a limited degree having an upper limit of 70 to 80 N (7 to 8 Kg). This tensile strength of the known brassiere closure is too low for a statistically relevant number of conditions of use, and it leads relatively frequently to damage having unpleasant consequences for the wearer of the brassiere.

OBJECT OF THE INVENTION

The object of the invention, therefore, is to design a closure of the above-described type such that, with the dimensions of the closure which substantially correspond to those of the known closures, a greater security of the closure against opening as a result of loading is achieved without impairing the handling of the closure with regard to the ease of the closing and opening thereof.

SUMMARY OF THE INVENTION

This object is achieved according to the invention, according to the fundamental idea, in that the latches, viewed in the closed configuration, are arranged between the edge webs facing one another of the eye regions inside bridge regions of the closure parts connecting the edge webs to one another. The latches are also arranged at a spacing from the transverse central plane of the closure extending at a right angle to the longitudinal edges of the eye openings. In addition, stable latching pins are provided as latching elements extending substantially at right angles to the separation plane of the closure parts and each pass through a respective female latching opening of the respective other closure part and engage behind a latching region of the edge thereof with a latching projection and as a result secure the latching element against being moved out of engagement with the female latching element By the arrangement provided below of the latches used to fix the closure parts to one another, such that the latches are moved from the region formed by the edges of the eyes themselves, in the vicinity of the opening, further into the inside of the entire closure arrangement, the opening widths of the female latching elements may be enlarged and a more stable design of the male latching elements may be implemented, which as a whole benefits the tensile loading capacity of the latching connections.

In this case, it is of particular significance that the tensile forces may be absorbed by relatively stable pins and the latching projections merely serve for securing the latching pins against axial displacement. The tensile forces that act substantially at right angles to the latching pins have practically no force components which could cause an axial displacement of the latching pins in the female latching elements. As a result, the loading capacity of the connection of the closure parts is effectively further increased and/or the probability of inadvertent opening of the closure is drastically reduced.

To this end, advantageous designs of the closure parts of the brassiere closure according to the invention, which may be used alternatively or in combination, are provided that are suitable both as a closure for a brassiere in the region of the cups as well as for a brassiere where rear parts might have to be connected to be secure under load, in order to resist in an equal manner increasing movement and decreasing movement which occurs, for example, during sport activity.

BRIEF DESCRIPTION OF THE DRAWING

Further details of the brassiere closure according to the invention are revealed from the description of a specific embodiment with reference to the drawings, in which.

DETAILED DESCRIPTION

Figure 1:
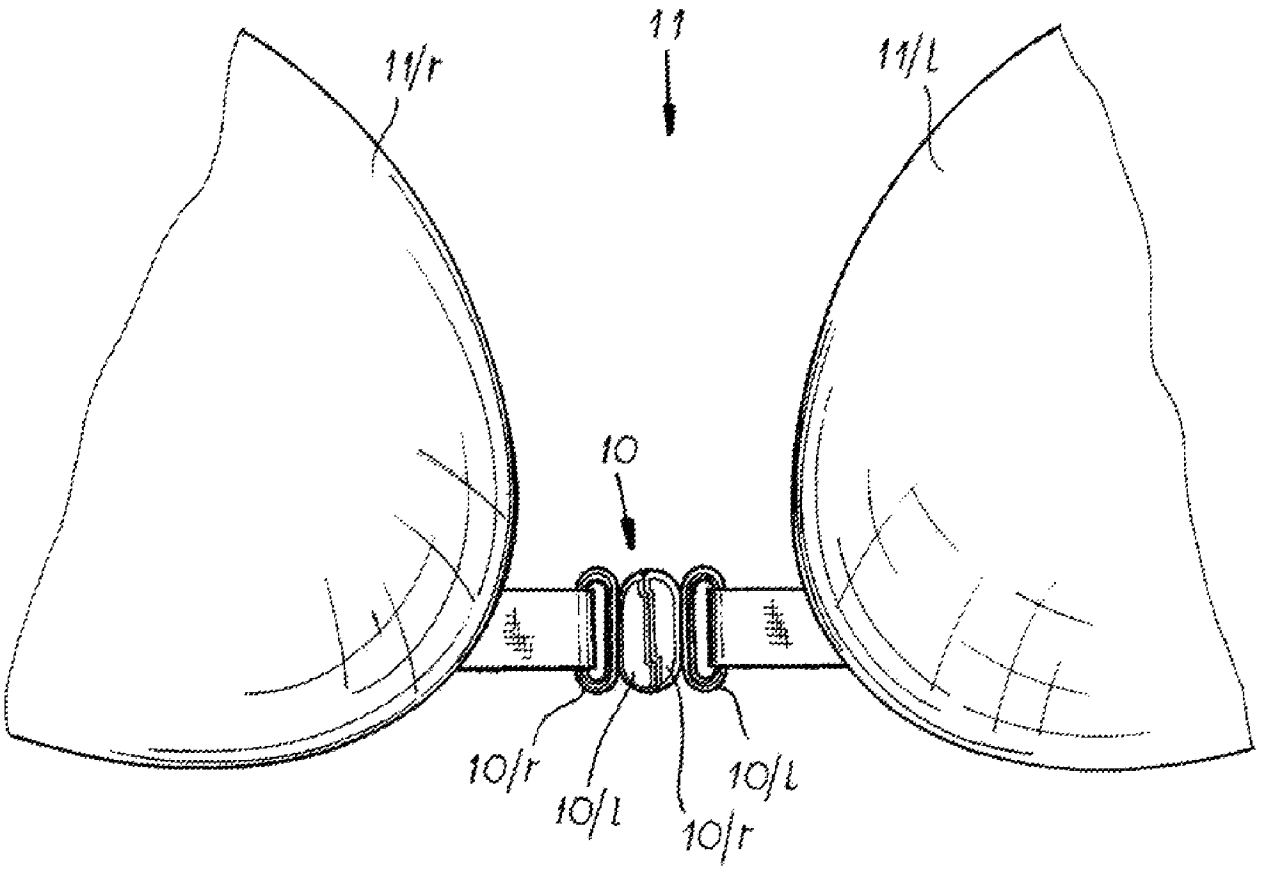
FIG. 1 shows a schematically simplified view of a brassiere having a closure according to the invention arranged between the cups.

The brassiere closure indicated in the drawings as a whole by 10 is shown in connection with a brassiere 11 in which the closure 10 is arranged between cups 11/*r* and 11/*l* of the brassiere 11. It is understood, however, that with a suitable design—not shown—of the rear parts of the brassiere 10 the closure may also be arranged on the back of the wearer.

The closure 10 is configured as a so-called simple closure in which two closure elements 10/*l* and 10/*r* which may be connected to one another, are each connected to a respective one of the two cups 11/*l* or 11/*r* and are of identical configuration.

Such a design implies that, as a whole, the closure in the assembled configuration is point-symmetrical relative to the geometric central point of the closure.

The two closure elements 10/*l* and 10/*r* are made as injection-molded plastics parts, preferably from POM (poly-oxymethylene). The closure elements 10/*l* and 10/*r* are designed such that they may be injection-molded in two-part molds, i.e. dies which have either one or more separation planes parallel to one another and which produce a continuous outer surface of the closure in a projection perpendicular to these planes.

Figure 2A:
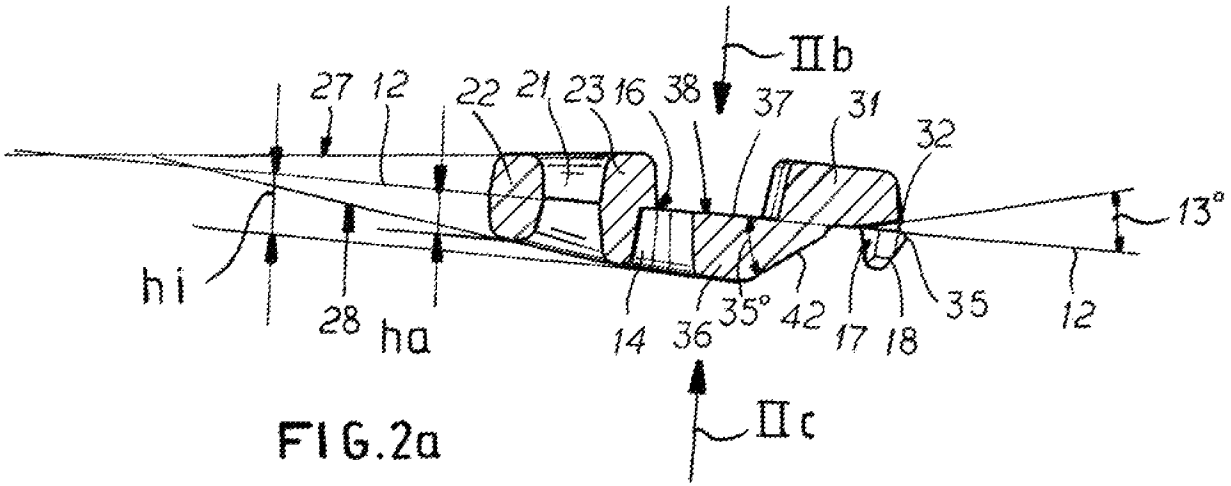
FIG. 2*a* is a large-scale view of a closure element of the closure according to FIG. 1 in section along the line 1*a*-1*a* of FIG. 2*b*.

The closure elements of the brassiere closure 10 according to the invention are designed such that for their manufacture a mold with only one separation plane is used which is shown in FIG. 2*a* at 12.

For fixing the two closure parts 10/*l* and 10/*r* together forming a closure 10, two latches shown generally at 13 are provided per closure 10 which each have a "female" opening 14 with an edge portion 16 that may be engaged from behind and a "male" latching pin 17. The fixing of the two closure parts 10/*l* and 10/*r* to one another may be achieved by the mutual non-positive/positive engagement thereof, in which a latching projection 18 of the "male" latching pin 17 engages behind the edge portion 16 of the "female" opening 14.

For closing together the closure 10, the parts thereof are pressed against one another after being mutually hooked together such that a guided relative movement of the closure parts 10/*l* and 10/*r* results, which in the last phase, i.e. directly before snapping the latching projection 18 into the position engaging behind the retaining edge portion 16 of the "female" opening 14, takes place perpendicular to the separation plane of the closure parts 10/*l* and 10/*r*, which are then held against one another in the closed configuration with their separation planes coplanar.

Figure 2C:
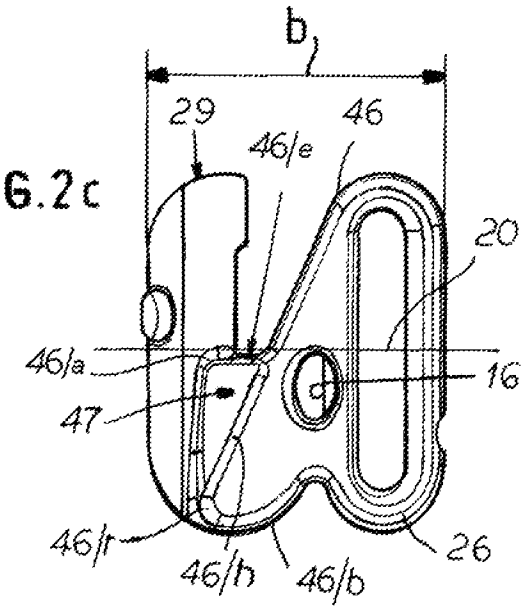
FIG. 2*c* is a simplified edge view of the closure element according to FIG. 2*b*, viewed in the direction of the arrow IIc of FIG. 2*a*, FIGS. 2*a*-2*c*.
Figure 3B:
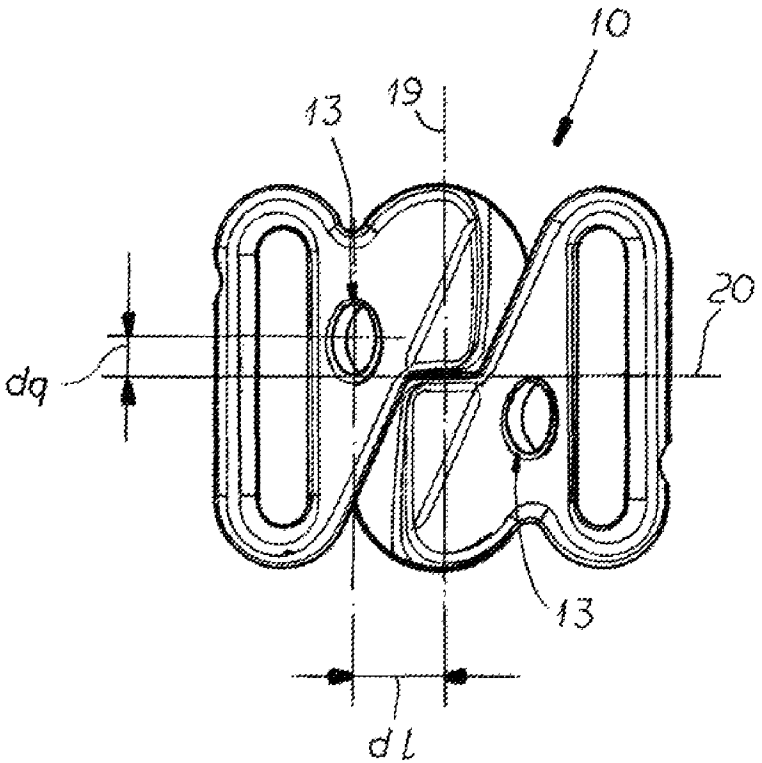
FIG. 3*b* is a view of the back of the closure turned toward the wearer.

The latching pins 17 and latching projections 18 of the two closure parts 10/*l* and 10/*r* to be connected to one another, which are used in pairs for forming a releasably fixed latch 13, are relatively offset, as may be seen most clearly from FIG. 3*b*, both relative to a longitudinal central plane 19 of the closure 10 and also relative to a transverse central plane 20 thereof, such that they are at a defined spacings dl and dq respectively from the longitudinal central plane 19 and from the transverse central plane 20, the spacing dl measured in the longitudinal direction in the embodiment selected for the explanation being approximately ⅛ of the length of the respective closure part 10/*l* and 10/*r* measured in the same direction and the spacing dq being approximately ¼ of a width b (FIG. 2*c*) of the respective closure part 10/*l* and 10/*r*.

In the design of the latch 13 described above, the tensile loading occurring in the closure is absorbed by the latching pins 17 which extend transversely to the separation plane 12, the force vector of the tensile loading extending, so to speak, in the separation plane of the closure parts 10/*l* and 10/*r* and at right angles to the longitudinal central plane 19 of the closure 10. The latching projections 18 prevent the two closure parts 10/*l* and 10/*r* fixed to one another from being moved apart and are practically not loaded and provide sufficient security against the closure parts 10/*l* and 10/*r* being moved apart perpendicular to the separation plane 12. Therefore, a relatively low supporting surface is sufficient, with which the latching projection engages behind the supporting edge 16 of the "female" latching element, in order to achieve a reliable fixing which, however, viewed in the transverse direction in which large forces may occur, is able to be relatively highly loaded.

The two closure parts are constructed as follows in detail:

The closure parts 10/*l* and 10/*r* each have an eye region which, apart from the opening of the respective latch 13, is symmetrical to the separation plane 12.

The eye region substantially borders the eye opening 21 and is configured as an oval ring which comprises two parallel longitudinal webs 22 and 23 and curved pieces 24 and 26 connecting the longitudinal webs 22 and 23 to one another, together bordering the slot-shaped eye opening 21.

The longitudinal web 22 externally bordering the eye opening 21 has, relative to the separation plane 12 of the closure part 10/*l* and/or 10/*r*, a lower height ha than the inner longitudinal web 23, the height thereof being denoted by hi. The thickness of the edge of the eye 21 measured perpendicular to the separation plane 12 continually increases from the value 2*ha* to the value 2*hi* in the region of the curved parts 24 and 26.

As shown in the cross-sectional view of FIG. 2*a*, the angles formed by the envelope planes 27 and 28 of the curved parts 24 and 26 "above" and "below" the separation plane 12 are approximately the same and in the specific embodiment shown are between 6° and 8°.

The hook shown at 29 is joined to the inner "higher" longitudinal defining web 23 of the eye region and serves for the non-positive/positive connection of the respective closure part 10/*l* and/or 10/*r* to the other closure part 10/*l* and/or 10/*r*.

Figure 2B:
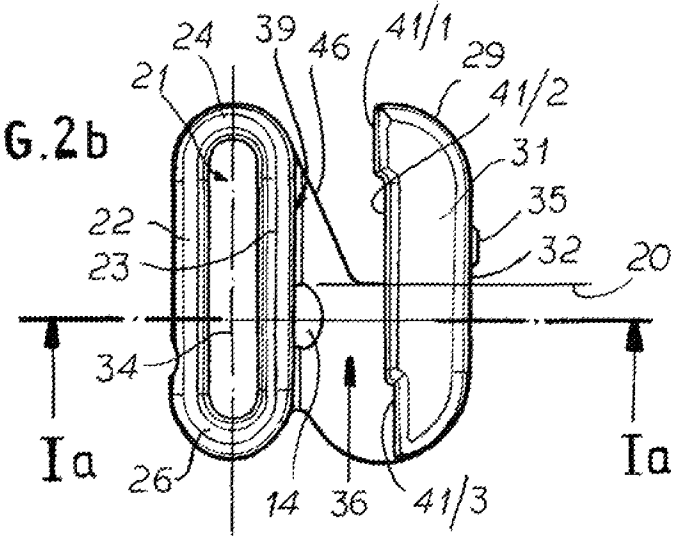
FIG. 2*b* is an edge view of the closure element according to FIG. 2*a* viewed in the direction of the arrow IIb of FIG. 1.

In the closed configuration of the brassiere closure 10, the eye regions of the two closure parts 10/*l* and 10/*r* held against one another are arranged with the "inner" higher longitudinal webs 23 parallel to and at a spacing from one another which substantially corresponds to double the value of the effective width of a hook limb 31 of the locking part 10/*l* or 10/*r*, which has an outer longitudinal edge 32 extending parallel to the longitudinal webs 22 and 23 of the observed locking part and, viewed in the closed configuration of the closure part, adjacent to the outer longitudinal web 22 of the adjacent locking part, over which, as viewed in FIGS. 2*a* and 2*b*, a narrow latching surface 35 of the latching projection 18 of the latching pin 17 projects, which may be brought into engagement with the "female" latching element 14 of the second closure part, the "male" latching element thereof in this case coming into engagement with the female latching element 14 of the above-described closure part 10/*l* and/or 10/*r*.

The design of the latching elements 14 and 17 and the arrangement thereof is such that the separation planes 12 and/or surfaces of the closure parts, when these are fastened to one another, are coplanar.

The hook limb 31 extending substantially parallel to the webs 22 and 23 of the eye region is arranged at a spacing from the adjacent "inner" longitudinal web 23 which is bridged by a bridge part 36 extending obliquely to the direction of extension of the longitudinal central plane 34 of the eye opening 21, which in its central region between the hook limb 31 and the inner longitudinal web 23 of the eye, has a planar floor 37 (FIG. 2*a*) extending in the separation plane of the relevant closure part, and moreover runs on one side "below" this separation plane. As a result, between the hook limb 31 of the hook 29 and the eye region a flat groove 38 is present which in the assembled state of the two closure elements 10/*l* and 10/*r* receives the hook limb 31 of the other closure element 10/*l* or 10/*r*.

According to the view of FIGS. 2*a* and 2*b* this groove 38 is defined by an inner edge 39 of the eye region, on the one hand, and portions 41/1, 41/2, and 41/3 extending parallel thereto of the inner edge of the hook limb 31. The hook limb 31 is joined to the side remote from the groove 38 "below" the separation plane 12 via an oblique surface 42 extending at 35° to a bridge region 36 forming the groove bottom, provided with the latching opening 14 through which the latching pin 17 of the second closure part penetrates and comes into engagement with the edge portion 16 extending parallel to the edges of the eyes, and having a small radius of curvature with a typical value of 0.3 mm where the bridge part 36 is joined to the closure element.

This feature of the closure 10 is provided in the view of the closure according to FIG. 3*b*.

The bridge part 36, within which most of the free cross-sectional area of the "female" latching element 14 (FIG. 2*b*) is located is to one side of the transverse central plane 20 of the closure part extending perpendicular to the groove floor 37 and at a right angle to the longitudinal central plane 34 of the eye opening 21, and is defined on the opposite side relative to this transverse central plane 20 (FIG. 2*b*) by an oblique edge 46 extending partially substantially in a straight line that, proceeding tangentially from the curved region 24 of the eye part, extends obliquely to the transverse central plane 20 as shown in FIG. 2*b*, and has a relatively short portion 46/*e* extending in this central plane and extends in this plane as far as the central portion 41/2 of the inner edge of the hook limb 31.

Figure 3A:
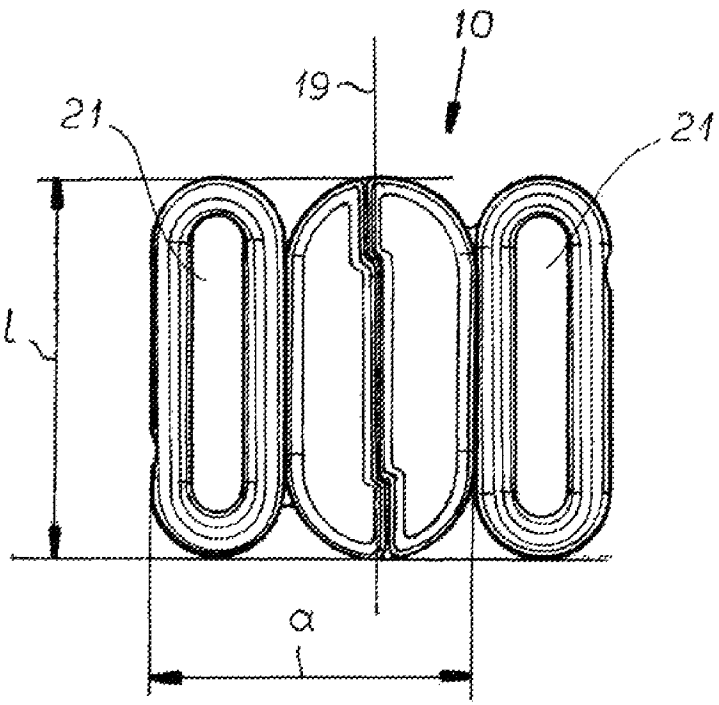
FIG. 3*a* is a view of the front of the brassiere closure turned away from the wearer as seen in FIG. 1.

This edge end portion 46/*e* of the bridge part edge 46 extending at right angles to the central edge portion 41/2 of the hook limb 31 forms the end stop, when combining the two closure parts 10/*l* and 10/4, as far as which the respective second closure part to be positioned on the first closure part and to be latched fixedly thereto may be inserted into a V-shaped opening region between the hook limb 31 and the eye region, for example as far as a position in which the longitudinal central planes of the closure parts to be connected to one another run at right angles to one another or are inclined in an X-shape relative to one another, after which by pressing together the closure elements until their groove floors 37 bear against one another in a coplanar manner, the closed position is achieved in which the two closure parts are fixed to one another. Proceeding from the view of FIG. 2*b*, the overall view of the locking parts connected to one another is provided in the view according to FIG. 3*a*.

On the side remote from the planar groove floor 37 of the closure part 10/*r* or 10/*l*, the view thereof being reproduced by the view of FIG. 2*c*, there is a step 46/*h* extending, so to speak, the curved edge of this step, a corner region 46/*r* thereof curved with a small radius merging with a bridge-edge region 46/*b* of the hook 29 curved with a relatively large radius of curvature, which in turn is again joined to the curved piece 26 with a small radius of curvature, which on this side borders the eye opening 21 of this closure part.

Between the sharply curved corner region 46/*r* (FIG. 2*c*) and the transverse edge 46/*e* in the region of the transverse central plane 20, extends a guide region 47 of right-triangular shape in the plan view of FIG. 2*c* and forming the angled face 42 of FIG. 2*a* that simplifies assembly of the two locking parts along the edge 46.

A corner region 46/*a* at the vertex of this triangle is located on the plane of the floor 37 of the groove 38 of the locking part; the corner of the triangular guide surface 47 located closest to the "female" latching element 14 is, according to the view of FIG. 2*a*, level with the lower envelope surface 28 of the respective closure part; the same is true for the corner of the triangular guide surface 47 merging into the curved corner region 46/*r*, which guide surface 47, when viewed in the sectional view of FIG. 2*a*, forms the angle of 35° with the separation plane 12 of the closure part.

By means of the guide surfaces 47, when assembling the locking parts 10/*l* and 10/*r* to be connected to one another, easy guidance of these parts relative to one another is achieved and thus the assembly in the correct position is substantially simplified.

In a typical design of the brassiere closure 10, the locking parts 10/*l* and 10/*r* thereof are produced with, for example, the following dimensions:

- Length l of the locking part, measured between the outer sides of the rounded portions 24 and 26 of the eye region: 13 mm
- Greatest thickness of the locking part, measured perpendicular to the separation plane 12: 3.29 mm
- Thickness of the longitudinal webs 22 and 23 of the eye region: 1.5 mm
- Clear width of the eye opening, measured at a right angle to the longitudinal edges: 1.5 mm
- Angle between the oblique base surface of the latching pin 17 and the separation plane of the closure element: 13°
- spacing a between the respective outer longitudinal edges of the eye region remote from one another and of the hooking part: 10.96 mm
- Greatest width b of the locking part measured between the outer longitudinal edge of the outer eye web and the outer edge of the latching projection 18 of the latching pin 17 remote therefrom: 11.19 mm.

In summary, the following is to be emphasized: in a closure 10 for a brassiere comprising two closure parts 10/*l* and 10/*r* of identical shape consisting of plastic, which by means of latches 13 having female latching elements 14 and male latching elements 17, may be fixedly and releasably connected to one another by non-positive/positive mutual engagement, and may be released again from one another by release actuation, at least two such latches 13 being effective which, viewed in the closed configuration of the closure 10, are arranged and designed to be point-symmetrical relative to the geometric center of gravity of the closure, the closure parts 10/*l* and 10/*r* for connecting to strip-shaped support elements having slot-shaped eyes 21 with longitudinal edges of the eye openings substantially symmetrical to a longitudinal central plane of the closure extending between the eye openings 21. The latches 13, viewed in the closed configuration, are between the edge webs 23 facing one another of the eye regions inside bridge regions of the closure parts 10/*l* and 10/*r* connecting the edge webs to one another, and are spaced from the transverse central plane 20 of the closure 10 extending at right angles to the longitudinal edges of the eye openings 21. Stable latching pins 17 are provided as latching elements extending substantially at right angles to the separation plane 22 of the closure parts and each pass through a respective female latching opening 14 of the other closure part and engage behind a latching region of the edge thereof with a latching projection 18 and as a result secure the latching element against being moved out of engagement with the female latching element.

The invention claimed is:

1. A brassiere closure comprising a pair of identical closure parts made of plastic and fittable together in a closed position with the closure parts flatly engaging each other at a separation plane, each of the closure parts being formed with:

an eye having inner and outer parallel longitudinal webs flanking and defining a slot adapted for connection to a strap, the separation plane passing through both of the webs and the slot, a transverse central plane perpendicular to the separation plane passing centrally through the slot and both of the webs;

a bridge extending transversely from the inner web and having a planar floor face lying on the separation plane and formed offset along the separation plane from the transverse plane with a throughgoing latch opening, the floor faces of the two closure parts lying against each other on the separation plane in the closed position, the bridge having an edge extending in a direction parallel to the separation plane away from the respective eye, each inner web lying between the respective edge and the respective outer web, each of the bridges having a back face formed with a triangular face region on a side opposite the floor face and inclined at an acute angle to the separation plane; and a hook carried on the bridge spaced along the separation plane from the respective eye and having an edge formed of sections extending perpendicular to the separation and transverse planes and facing toward the respective eye, the edges of the bridge and of the hook forming a V-shaped opening, an outer edge of the hook being formed with a pin engageable in the closed position through the latch opening of the bridge of the other closure part, the pins each having a projection fitting behind an edge of the latch opening of the other closure part in the closed position.

2. A brassiere closure comprising a pair of identical closure parts made of plastic and fittable together in a closed position with the closure parts flatly engaging each other at a separation plane, each of the closure parts being formed with:

an eye having inner and outer parallel longitudinal webs flanking and defining a slot adapted for connection to a strap, the separation plane passing through both of the webs and the slot, a transverse central plane perpendicular to the separation plane passing centrally through the slot and both of the webs;

a bridge extending transversely from the inner web and having a planar floor face lying on the separation plane and formed offset along the separation plane from the transverse plane with a throughgoing latch opening, the floor faces of the two closure parts lying against each other on the separation plane in the closed position, the bridge having an edge extending in a direction parallel to the separation plane away from the respective eye, each inner web lying between the respective edge and the respective outer web, the edge of the bridge being straight and extends extending from immediately adjacent the respective inner web away from the respective eye toward the transverse plane, the sections of the edge of the hook being stepped outward away from respective eye; and a hook carried on the bridge spaced along the separation plane from the respective eye and having an edge formed of sections extending perpendicular to the separation and transverse planes and facing toward the respective eye, the edges of the bridge and of the hook forming a V-shaped opening, an outer edge of the hook being formed with a pin engageable in the closed position through the latch opening of the bridge of the other closure part, the pins each having a projection fitting behind an edge of the latch opening of the other closure part in the closed position.

* * * * *